US005735157A

United States Patent [19]

Yamamoto et al.

[11] Patent Number: 5,735,157

[45] Date of Patent: Apr. 7, 1998

[54] ROLL WIDTH ADJUSTING DEVICE

[75] Inventors: Yasuhiro Yamamoto, Souraku-gun; Masaru Nagao, Neyagawa, both of Japan

[73] Assignee: Hitachi Zosen Corporation, Osaka, Japan

[21] Appl. No.: 761,720

[22] Filed: Dec. 6, 1996

Related U.S. Application Data

[62] Division of Ser. No. 478,559, Jun. 7, 1995, Pat. No. 5,660, 068.

[30] Foreign Application Priority Data

| | | | |
|---|---|---|---|
| Jun. 9, 1994 | [JP] | Japan | 6-127193 |
| Nov. 25, 1994 | [JP] | Japan | 6-290240 |
| Apr. 7, 1995 | [JP] | Japan | 7-81606 |

[51] Int. Cl.[6] ..... B21D 3/02

[52] U.S. Cl. ..... 72/164; 72/224; 72/247

[58] Field of Search ..... 72/247, 224, 225, 72/160, 164

[56] References Cited

U.S. PATENT DOCUMENTS

| | | | |
|---|---|---|---|
| 2,774,263 | 12/1956 | Leufven | 72/247 |
| 3,323,345 | 6/1967 | Lyle et al. | 72/239 |
| 3,979,939 | 9/1976 | Pazderka | 72/239 |
| 4,653,304 | 3/1987 | Feldmann et al. | 72/239 |
| 4,706,485 | 11/1987 | Gilvar et al. | 72/239 |
| 4,726,108 | 2/1988 | Poloni | 29/281.1 |
| 4,745,788 | 5/1988 | Takemasa et al. | 72/160 |
| 5,154,074 | 10/1992 | Haraguchi | 72/247 |

FOREIGN PATENT DOCUMENTS

| | | | |
|---|---|---|---|
| 2281801 | 3/1976 | France . | |
| 500989 | 6/1930 | Germany . | |
| 3616699 | 11/1987 | Germany . | |
| 58-20329 | 2/1983 | Japan . | |
| 58-61922 | 4/1983 | Japan . | |
| 61-289917 | 12/1986 | Japan . | |
| 1-317622 | 12/1989 | Japan . | |
| 284717 | 11/1990 | Japan | 72/247 |
| 3-210915 | 9/1991 | Japan . | |
| 5-123752 | 5/1993 | Japan . | |

*Primary Examiner*—Daniel C. Crane

*Attorney, Agent, or Firm*—D. Peter Hochberg; Mark Kusner

[57] ABSTRACT

A bearing mount assembly is installed in opposed relation to a roll support frame with the pass line interposed therebetween, the bearing mount assembly being provided with bearings capable of removably supporting the front ends of roll shafts carried on the roll support frame. In roll exchange operation, the bearing mount assembly is moved away from the roll support frame and has its bearings removed therefrom, whereupon the bearing mount assembly is turned from this raised position to a flat position to provide a roll exchange operation space defined above the bearing mount assembly, making it possible to effect roll exchange operation.

2 Claims, 15 Drawing Sheets

ROLL WIDTH ADJUSTING DEVICE

This is a divisional of application Ser. No. 08/478,559 filed on Jun. 7, 1995, now U.S. Pat. No. 5,660,068 issued Aug. 26, 1997.

FIELD OF THE INVENTION

The present invention relates to a device for quickly effecting roll exchange and roll width change attending workpiece change, in a roll processing facility wherein rolls are pressed against a workpiece moving along a pass line for workpiece rolling and correcting operations.

BACKGROUND OF THE INVENTION

Known roll type rolling machines and roll type correcting machines are classified into two types: the cantilever type in which the roll shafts are supported by a roll support frame installed on one side of the pass line, and the dual-support type in which the roll shafts are supported by two roll support frames installed on the opposite sides of the pass line.

In the cantilever type with roll shales supported on one side, since the other side of the roll shafts are open, roll exchange is easy. However, in the cantilever type, a heavy load on the rolls would present a problem that the roll shafts deflect to make precision processing impossible. In the dual-support type with roll shafts supported at opposite sides, there is a problem that roll exchange takes much time.

In recent years, the number of types of workpieces has increased, and there are many workpieces in the form of steel shapes which are equal in shape but different in size, suited to variety type small quantity production. However, in the known art, since the stroke for adjusting the roll width is so short that the number of distance sleeves used between rolls has to be increased or decreased to adjust the roll distance for each type of workpieces or roll exchange has to be made, presenting a problem that much time is taken for change of workpiece type.

DISCLOSURE OF THE INVENTION

Accordingly, an object of the present invention is to provide a roll type processing facility capable of quickly exchanging rolls involving less deflection of roll shafts even under heavy load, and a roll width adjusting device for roll type processing facilities capable of making roll width adjustment in a wide range.

To achieve this object, according to the invention, there is provided a roll type processing facility wherein on one side of the pass line there is a roll support frame projecting toward the pass line and having a plurality of roll shafts with straightening rolls mounted thereon and on the other side of the pass line there is a bearing mount assembly provided with bearings for supporting the front ends of said roll shafts, said roll type processing facility being characterized in that said bearings on said bearing mount assembly are designed for removable mounting on the roll shafts, and said bearing mount assembly is movable toward and away from the roll support frame, said bearings on said bearing mount assembly being adapted to be removed from the roll shafts at a position remote from the roll support frame, said bearing mount assembly being movable between a first position where it is raised around an axis parallel with the pass line and a second position where it is turned flat around said axis, the arrangement being such that the space available above said bearing mount assembly which is now turned flat is used as a roll exchange operation space in performing roll exchange operation.

Further, in said roll type processing facility arranged in the manner described above, there is provided a roll exchange device adapted to be moved into the roll exchange operation space so as to make it possible to exchange straightening rolls.

Further, according to the invention, there is provided a roll processing facility wherein on one side of the pass line there is a roll support frame projecting toward the pass line and having a plurality of roll shafts with straightening rolls mounted thereon and on the other side of the pass line there is a bearing mount assembly provided with removable bearings for supporting the front ends of said roll shafts, said roll type processing facility being characterized in that said bearings on said bearing mount assembly are designed for removable mounting on the roll shafts, and said bearing mount assembly is movable toward and away from the roll support frame, said bearings on said bearing mount assembly being adapted to be moved for shunting in parallel with the pass line from a position remote from the roll support frame, the arrangement being such that the space on the front end side of the roll shafts after the bearing mount assembly has been moved is used as a roll exchange operation space for performing roll exchange operation.

Further, in said roll processing facility arranged in the manner described above, there is provided a roll exchange device adapted to be moved into the roll exchange operation space so as to make it possible to exchange straightening rolls.

Further, according to the invention, there is provided a roll width adjusting device in a roll processing facility having a pair of straightening rolls fitted on a roll shaft projecting from a roll support frame toward the pass line, said roll width adjusting device being characterized in that said straightening rolls consist of a fixed roll fixed on the roll shaft and a movable roll movable toward and away from the fixed roll, and in that said adjusting device comprises an inner taper sleeve fitted for slide movement within a predetermined range on the roll shaft, an outer taper sleeve fitted on said inner taper sleeve such that its inner peripheral taper surface contacts the outer peripheral taper surface of said inner taper sleeve, a roll sleeve fitted on said outer taper sleeve and having said movable roll fitted thereon for axial snide movement, an adjusting male threaded portion formed on the outer peripheral surface of said roll sleeve, a width change sleeve, fitted on said roll sleeve and having an adjusting female threaded portion threadedly engaged with said adjusting male threaded portion of said roll sleeve and connected to the movable sleeve, a sleeve locking element capable of preventing rotation of said width change sleeve, sleeve expanding and contracting means adapted to respond to the axial slide movement of the inner taper sleeve by expanding or contracting the outer diameter of the roll sleeve by its taper surface to thereby fix or release said movable roll and width change sleeve to or from the roll shaft, and roll position adjusting means whereby with the movable roll and width change sleeve released from the roll shaft by said sleeve expanding and contracting means and with the width change sleeve prevented by the sleeve locking element from rotating, the rotation of the roll shaft causes the width change sleeve and movable roll to slide axially under the action of the adjusting male and female threaded portions.

Further, in said roll width adjusting device in a roll processing facility, the roll shaft is rotatably supported in the roll support frame, the front end of the roll shaft is removably supported in a bearing on a bearing mount assembly which is movable toward and away from the roll support frame, a returning oil chamber and a thrusting oil chamber formed on the opposite ends of the inner taper sleeve in the sleeve expanding and contracting means for axially sliding the inner taper sleeve, an oil feed hole is formed in the roll shaft for supplying hydraulic pressure to said returning and thrusting oil chambers, and a coupling is installed on that end of the roll shaft which is associated with the roll support frame.

According to the first roll type processing facility described above, the front end of the roll shaft supported at its base end by the roll support frame, thus making it possible to eliminate errors of the straightening roll due to deflection of the roll shaft, as compared with the conventional cantilever type roll shaft, so that workpieces can be roll-corrected with high accuracy. Further, for straightening roll exchange operation, the bearing mount assembly is moved away from the roll support frame and the bearing is released from the roll shaft, whereupon the bearing mount assembly is turned from its raised position to its turning-flat position; thus, a roll exchange operation space available above the bearing mount assembly is utilized to effect roll exchange operation easily and quickly.

Further, according to the second roll type processing facility described above, for straightening roll exchange operation, the bearing mount assembly is moved away from the roll support frame and the bearing is released from the roll shaft, whereupon the bearing mount assembly is moved for shunting in parallel with the pass line; thus, a roll exchange operation space available at the front end of the roll shaft after the bearing mount assembly has been moved is utilized to effect roll exchange operation easily and quickly. Therefore, as compared with a roller correcting machine having a conventional dual-support type roll shaft, the operating time required for roll exchange is reduced to a great degree.

Further, in the arrangement of the aforesaid roll type processing facility, the roll exchange device is moved into the roll exchange operation space subsequent to the turning-flat or movement of the bearing mount assembly, and straightening roll exchange operation is efficiently performed.

Further, according to the roll width adjusting device in a roll processing facility according to the invention, the roll width change operation is easily effected by stopping the rotation of the roll shaft, preventing the width change sleeve by the sleeve locking element from rotating, releasing the movable roll and width change sleeve by the sleeve expanding and contracting means from fixing, and sliding the movable roll by the roll position adjusting means, and it is also possible to adjust the spacing between the fixed and movable rolls within the range of the effective length of the adjusting female threaded portion; thus, the roll width can be adjusted within a greater stroke range as compared with the conventional art.

DESCRIPTION OF EMBODIMENTS

Figure 1:
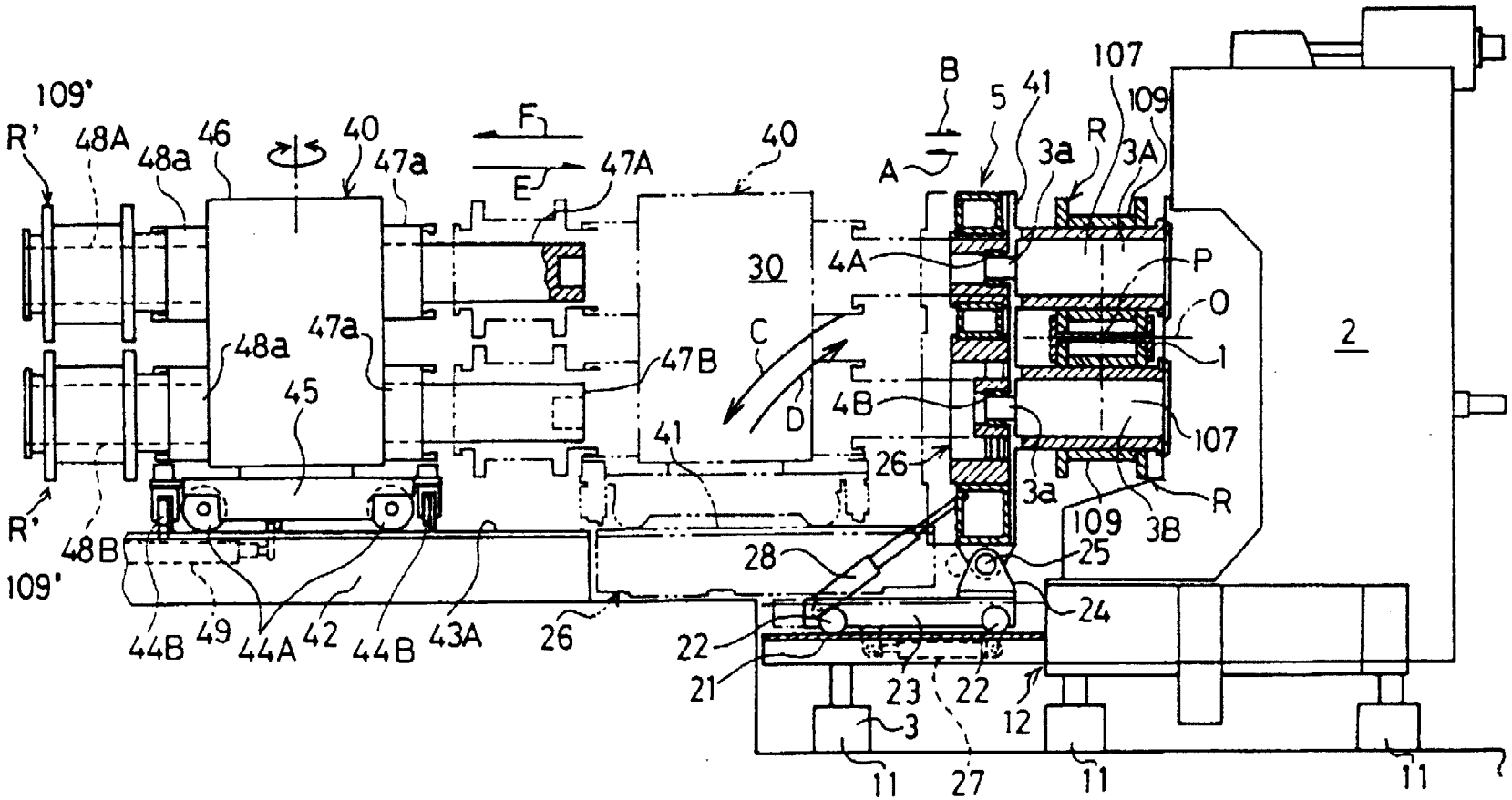
FIG. 1 is a front view, partly in section, showing a first embodiment of a roller correcting facility according to the present invention.
Figure 2:
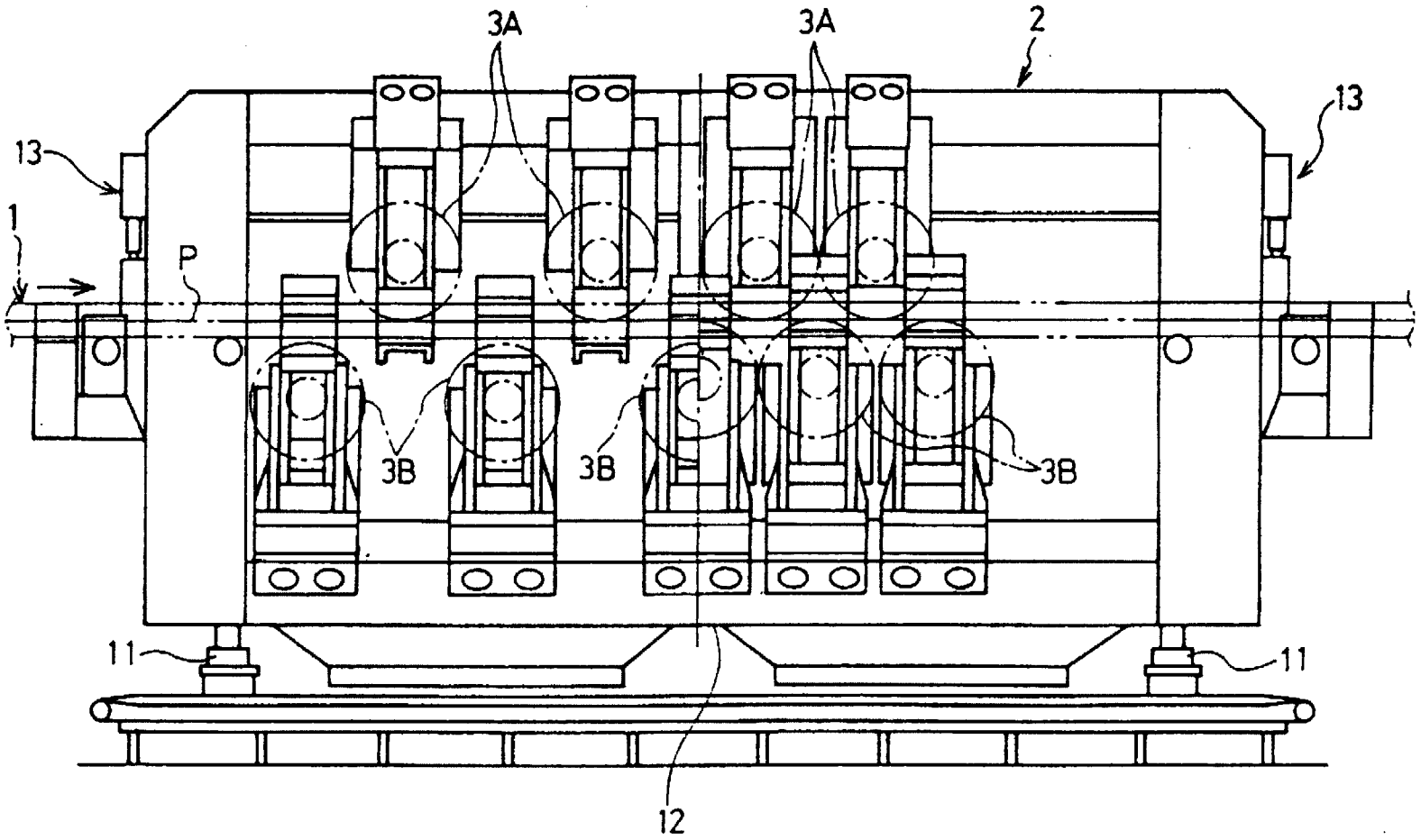
FIG. 2 is a side view showing a roll support frame for said roller correcting facility.
Figure 3:
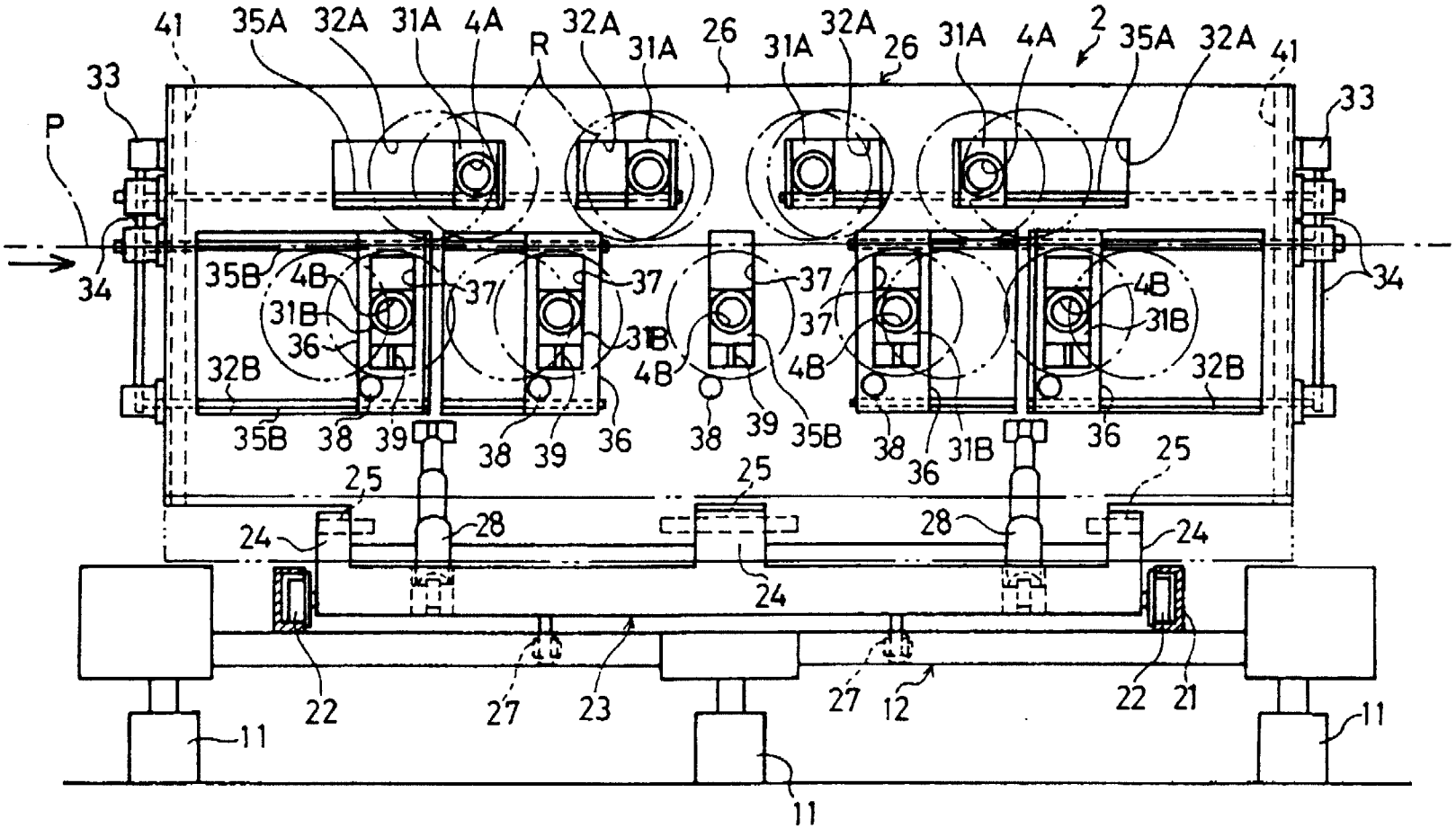
FIG. 3 is a side view showing a bearing mount assembly in said roller correcting facility.
Figure 4:
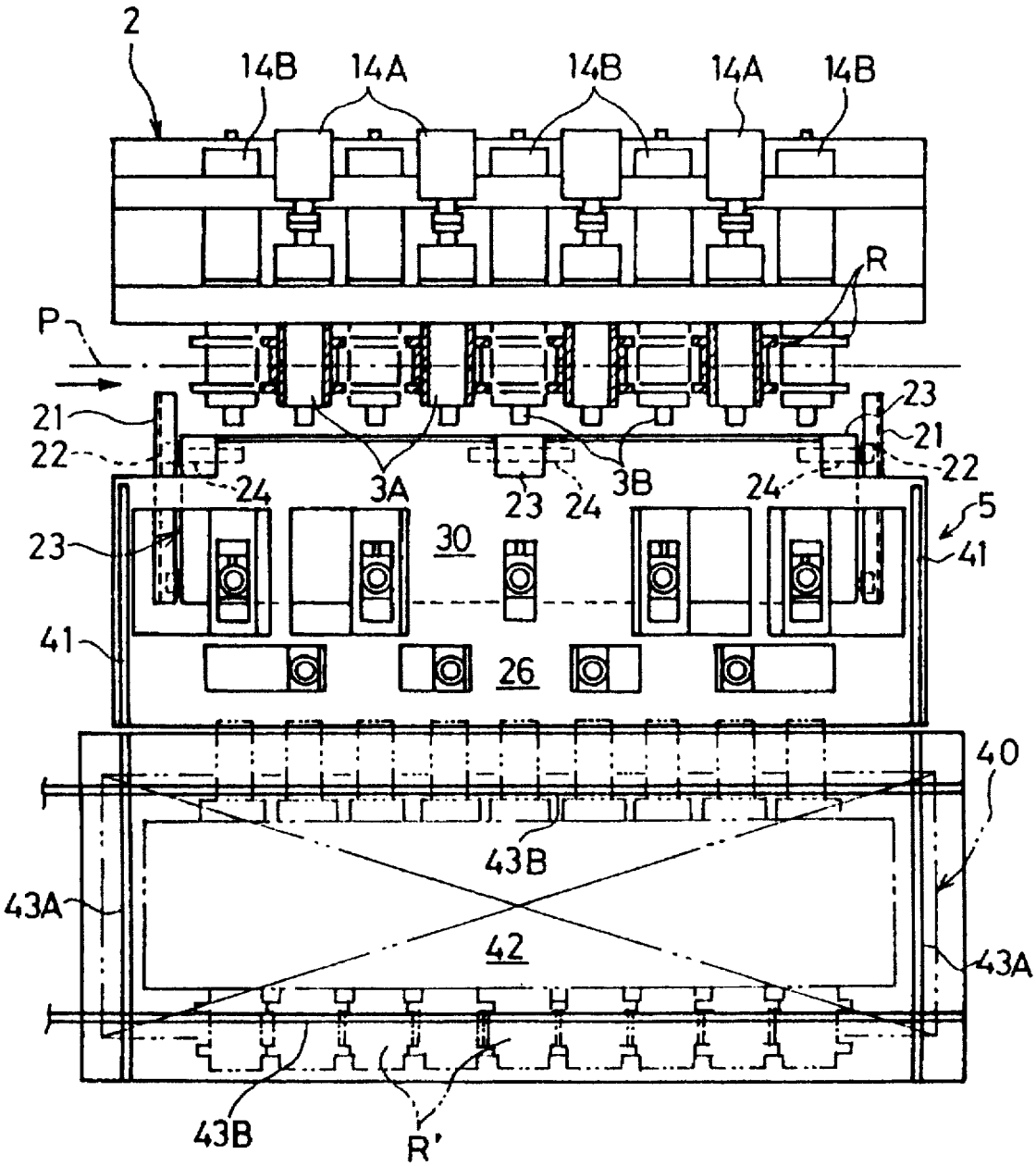
FIG. 4 is a plan view showing the turned-flat position of the bearing mount assembly.

A first embodiment of a roller correcting facility which is an example of a roll type processing facility will now be described with reference to FIGS. 1 through 4.

A fixed type roll support frame 2 is disposed on the left-hand side of a pass line P along which an H-steel shape which is a workpiece is passed. Further, disposed on the right-hand side of the pass Nine P is a movable type bearing mount assembly 5 wherein the front ends of pluralities of upper and lower roll shafts 3A and 3B are rotatably supported by bearings (self-aligning roller bearings) 4A and 4B.

The roll support frame 2 is disposed on a support table 12 supported by a plurality of jacks 11. The vertical positions of the roll shafts 3A and 3B are adjusted by these jacks 11. The four upper roll shafts 3A disposed above the pass line P have their positions in the direction along the pass line adjusted by pitch adjusting devices 13. Further, the five lower roll shafts 3B disposed under the pass line P, except the central lower roll shaft 3B, have their positions in the direction along the pass line P adjusted by said pitch adjusting devices 13. Further, the lower roll shafts 3B have their vertical positions adjusted by a lifting device (not shown). And the upper and lower roll shafts 3A and 3B are driven for rotation by a roll shaft driving device having roll drive motors 14A and 14B.

A pair of transversely spaced guide rails 21 are laid on said support table 12 to extend in a direction crossing the pass line P at right angles. Said bearing mount assembly 5 comprises a support carriage 23 guided for movement on the guide rails 21 by guide wheels 22, a bearing frame 26 in which support shaft 25 is rotatably supported by brackets 24, moving cylinder devices 27 for moving the support carriage 23 along the guide rails 21, and rotating cylinder devices 28 for rotating the bearing frame 26. With this arrangement, as the moving cylinder devices 27 are expanded and contracted, said support carriage 23 is moved along the guide rails toward and away from the roll support frame 2 in the directions of arrows A and B. The bearing frame 26 is decreased in thickness in the direction crossing the pass line P at right angles. And the bearing frame 26 is turned around the axis of the support shaft 25 in the directions of arrows C and D by rotating cylinder devices 28 between a raised position and a flat position.

The upper and lower bearings 4A and 4B are disposed in said bearing frame 26 correspondingly to the upper and lower roll shafts 3A and 3B. These upper and lower bearings 4A and 4B are adapted to have removably fitted therein support portions **3*a* of small diameter formed on the front ends of the upper and lower roll shafts 3A and 3B. Further, these upper and lower bearings 4A and 4B are designed so that their positions can be adjusted correspondingly to the upper and lower roll shafts 3A and 3B**.

That is, the upper bearings 4A supporting the support portions **3*a* of the upper roll shafts 3A are received in bearing boxes 31A. Further, the bearing frame 26 is formed with guide openings 32A extending in the direction of the pass line P. And the bearing boxes 31A are slidably disposed respectively in these guide openings 32A. Further, upper threaded shafts 35A adapted to be driven for rotation by the pitch adjusting motors 33 pass through the guide openings 32A. And female threaded members (not shown) provided in the bearing boxes 31A are fitted on the upper threaded shafts 35A. Therefore, the upper threaded shafts 35A are rotated by the pitch adjusting motors 33 to slide the bearing boxes 31A, thereby adjusting the pitch of the upper bearing boxes 4A**.

Further, the lower bearings 4B supporting the support portions **3*a* of the lower roll shafts 3B received in bearing boxes 31B. The bearing frame 26 is formed, except at its middle region, with guide openings 32B extending in the direction of the pass line P, with slide frames 36 slidably disposed respectively in said guide openings 32B. These slide frames 36 are formed with vertical lifting guide openings 37, with bearing boxes 31B slidably disposed in said lifting guide openings 37. Each slide frame 36 has disposed therein a lifting threaded shaft 39 driven for rotation by a vertical position adjusting motor 38, said lifting threaded shaft 39 being connected to the bearing box 31B. Further, lower threaded shafts 35B connected to intermediate shafts 34 driven by the pitch adjusting motors 33 extend through the guide openings 32B, and female threaded members (not shown) provided in the slide frames 36 are fitted on the lower threaded shafts 35B**.

Therefore, the lower threaded shafts 35B are rotated by the pitch adjusting motors 33 to slide the slide frames 38 along the guide openings 32B, thereby adjusting the pitch. Further, the lifting threaded shafts 39 are rotated by the vertical position adjusting motors 38 to move the bearing boxes 31B vertically along the lifting guide openings 37, so as to effect positional adjustment.

Further, on that lateral surface of the bearing frame 26 of the bearing mount assembly 5 which is associated with the roll support frame 2, that is, on the fore and aft edges of the surface which becomes the upper surface when it is turned flat by the inclining cylinder devices 28, traveling auxiliary rails 41 are laid to extend in the direction crossing the pass line at right angles. The traveling auxiliary rails 41 are disposed at positions where they are continuous with exchanging transverse traveling rails 43A, the latter being laid on the working floor 42 at the lateral side of the support table 12. And the space above the bearing frame 26 in its turned-flat position serves as a roll exchange operation space 30.

Disposed on the working floor 42 is a roll exchange carriage 40 which is an example of a roll exchange device for exchanging straightening rolls R mounted on the upper and lower roll shafts 3A and 3B. The roll exchange carriage 40 comprises a traveling carriage 45 having traveling wheels 44A and 44B, and an exchange shaft frame 46 disposed on said traveling carriage 45 and adapted to be reversed within the ravage of 180° around a vertical axis. Said traveling carriage 45 is adapted to travel to the roll exchange operation space 30 as its traveling wheels 44A and 44B guided by the traveling auxiliary rails 41 of the bearing frame 26, the exchange transverse traveling rails 43A and the exchange longitudinal traveling rails 43B.

One lateral surface of the exchange shaft frame 46 is provided with roll receiving shafts 47A and 47B extending therefrom and respectively opposed to the upper and lower roll shaft 3A and 3B. The other lateral surface of the exchange shaft frame 46 is provided with roll transfer shafts 48A and 48B extending therefrom and adapted to have fresh press rolls R' mounted thereon. The numeral 49 denotes traveling cylinders for moving the roll exchange carriage 40 in the directions of arrows E and F along the exchange transverse traveling rails 43A and the traveling auxiliary rails 41.

The roll exchange operation in the roll correcting facility arranged in the manner described above is as follows.

(1) On completion of the correcting operation, the drive motors 14A and 14B are stopped, whereupon the pitch adjusting devices 13 and the pitch adjusting motors 33 and upper and lower position adjusting motors 38 are driven to slide the upper and lower shafts 3A and 3B and upper and lower bearing boxes 31A and 31B to return to the exchange preparation position.

(2) The moving cylinder devices 27 are extended to retract the bearing mount assembly 5 in the direction of arrow A, releasing the bearings 4A and 4B from the support portions **3*a* of the roll shafts 3A and 38. And the rotating cylinder devices 28 are contracted to turn the bearing frame 26** in the direction of arrow C from the raised position to the flat position.

(3) The roll exchange carriage 40 standing by on the working floor 42 is moved by the traveling cylinder devices 49 from the working longitudinal traveling rails 43B to the exchange transverse traveling rails 43A. Further, the traveling cylinder devices 49 move the roll exchange carriage 40 in the direction of arrow E from the exchange transverse traveling rails 43A to the traveling auxiliary rails 41 and into the roll exchange operation space 30. And the roll receiving shafts 47A and 47B of the exchange shaft frame 46 are connected to the roll shafts 3A and 3B, respectively.

(4) Subsequently, the straightening rolls R' mounted on the roll shafts 3A and 3B are released from their fixed state by the operation of roll width adjusting devices 107 to be later described. The roll receiving shafts 47A and 47B have exchange slide devices **47*a* slidably fitted thereon, said exchange slide devices 47*a* being driven until their locking teeth are locked by the press rolls R, whereupon the straightening rolls R together with the roll sleeves 109 are slid from the roll shafts 3A and 3B toward the roll receiving shafts 47A and 47B** and are removed.

(5) After the roll exchange carriage 40 has been moved in the direction of arrow F to the working floor 42 by the traveling cylinder devices 49, the exchange frame 46 is turned through 180° C. Thereby, the roll transfer shafts 48A and 48B having the next straightening rolls R' mounted thereon are opposed to the roll shafts 3A and 3B. And the roll exchange carriage 40 is moved by the traveling cylinder devices 49 until the roll transfer shafts 48A and 48B are connected to the roll shafts 3A and 3B, respectively.

(6) The roll transfer shafts 48A and 48B have exchange slide devices **48*a* respectively mounted thereon, and these exchange slide devices 48*a* are driven, whereby the straightening rolls R' together with roll sleeves 109' are slid from the roll transfer shafts 48A and 48B** to the roll shafts 3A and 3B to be mounted on the latter, whereupon they are fixed on the roll shafts 3A and 3B by the operation of the roll width adjusting device to be later described.

(7) And the roll exchange carriage 40 is retracted in the direction of arrow F to the working floor 42 by the traveling cylinder devices 49. Thereafter, the rotating cylinder devices 28 are extended to turn the bearing frame 26 in the direction of arrow D from the flat position to the raised position. Then, the moving cylinder devices 27 are contracted to move the bearing mount assembly 5 in time direction of arrow B until the bearings 4A and 4B on the bearing mount assembly 5 are fitted on the support portions **3*a*** of the roll shafts 3A and 3B.

(8) Further, the roll width of the straightening rolls R' is adjusted by the roll width adjusting devices 107, and the pitch adjusting devices 13 and pitch adjusting motors 33 and upper and lower position adjusting motors 38 are driven to slide the roll shafts 3A and 3B and the bearing boxes 31A and 31B, thereby adjusting the correcting position of the roll shafts 3A and 3B.

According to the above embodiment, the bearing mount assembly 5 supporting the front ends of the roller shafts 3A and 3B through the bearings 4A and 4B are rotated to move the roll exchange device 40 into the roll exchange operation space defined above the bearing frame 26 now turned flat; thus, the exchange operation of the straightening rolls R can be easily and quickly effected.

Since the bearing mount assembly 5 is installed on the roller correcting machine provided with the roll support frame 2 supporting one of the respective ends of the roll shafts 3A and 3B, the same rigidity as that obtained by dual-support type roll shafts can be attained, thus making accurate correction possible. Further, the bearing mount assembly 5 may be added to an existing correcting machine having cantilever type roll shafts.

Next, a second embodiment of a roller correcting facility will be described with reference to FIGS. 5 through 10. In addition, the same members as those used in the first embodiment are denoted by the same reference characters, and a description thereof is omitted.

Figure 5:
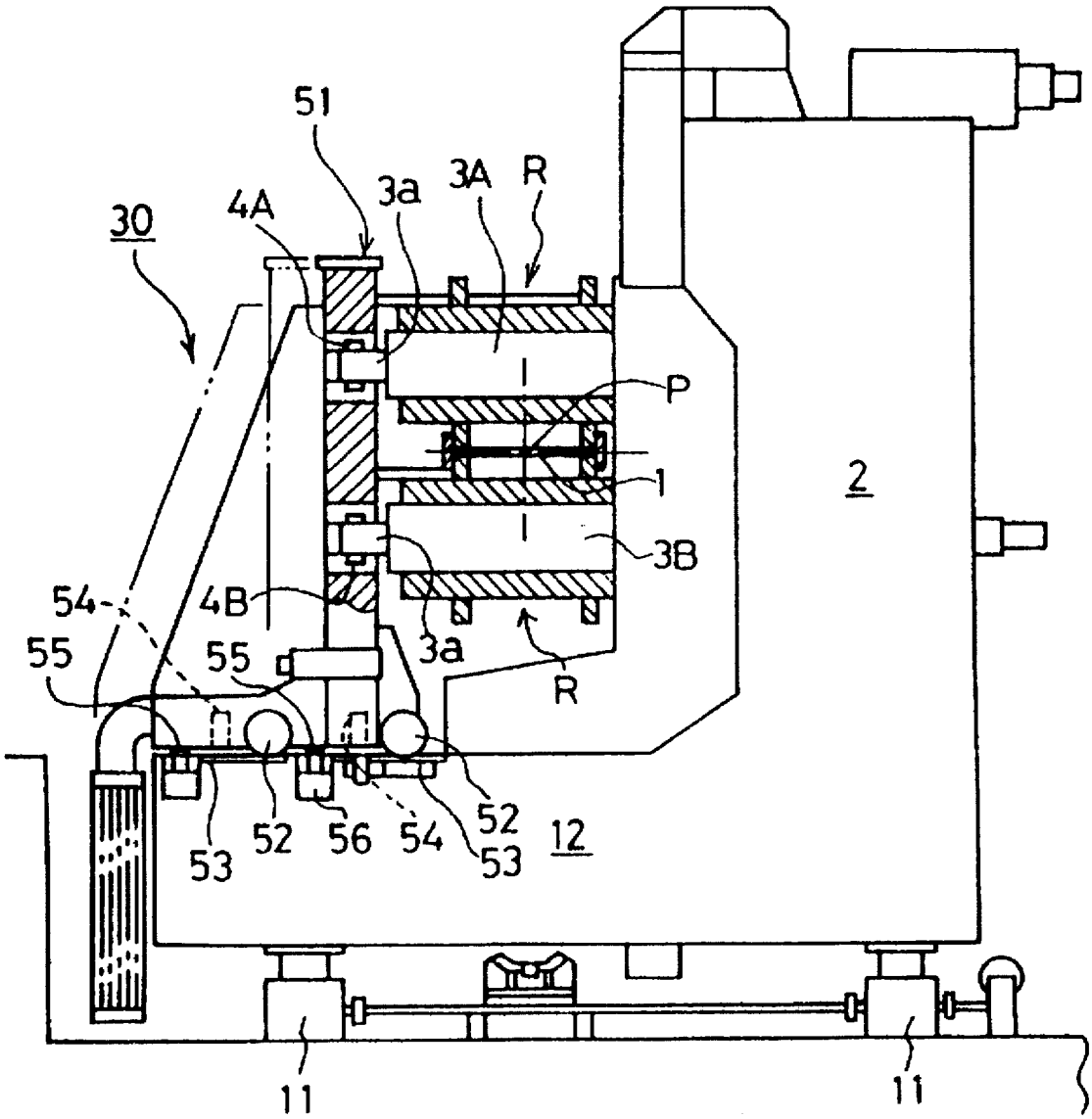
FIG. 5 is a front view showing a second embodiment of a roller correcting facility according to the present invention.
Figure 6:
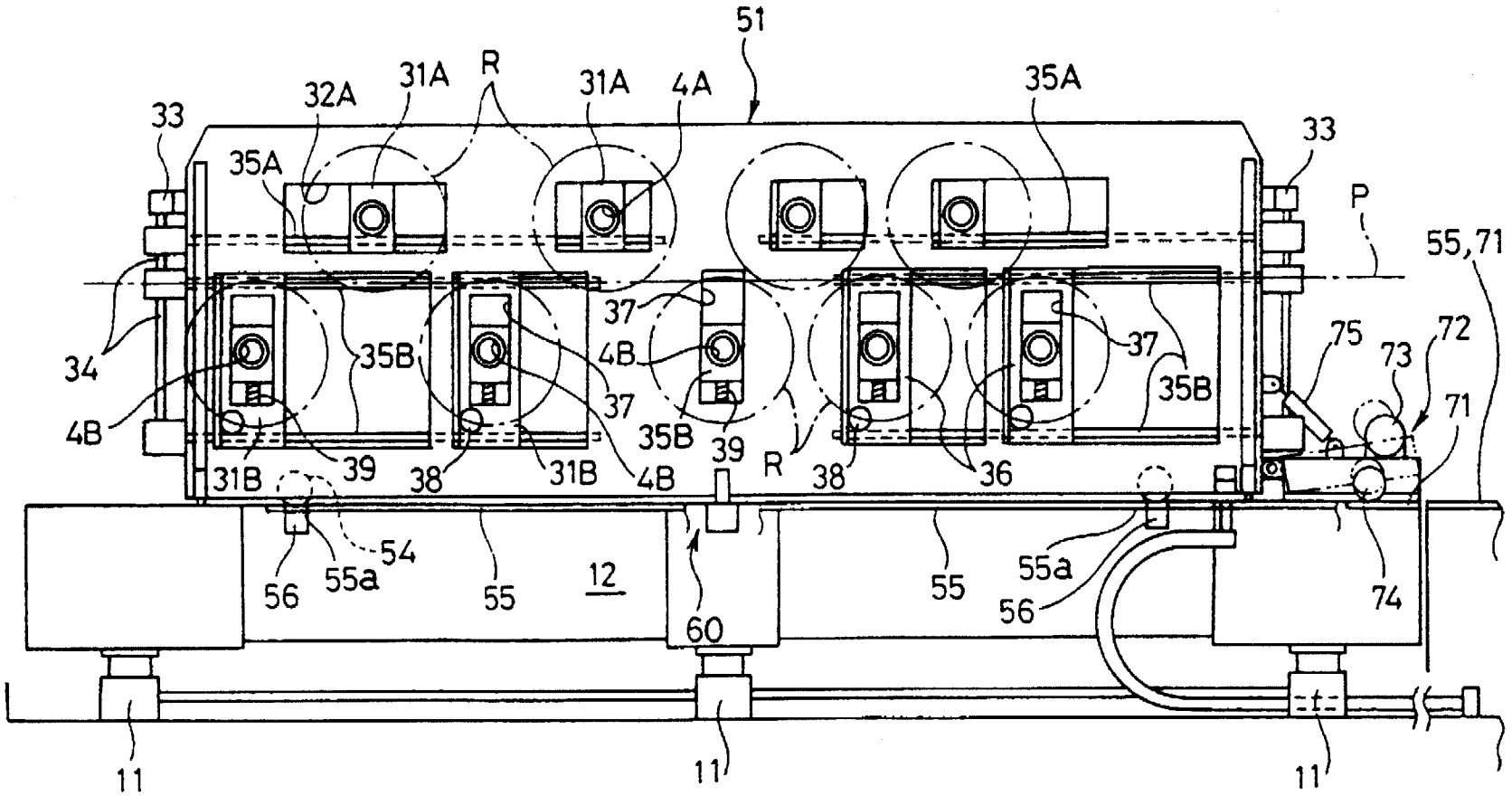
FIG. 6 is a side view showing a roll support frame for said roller correcting facility.
Figure 7:
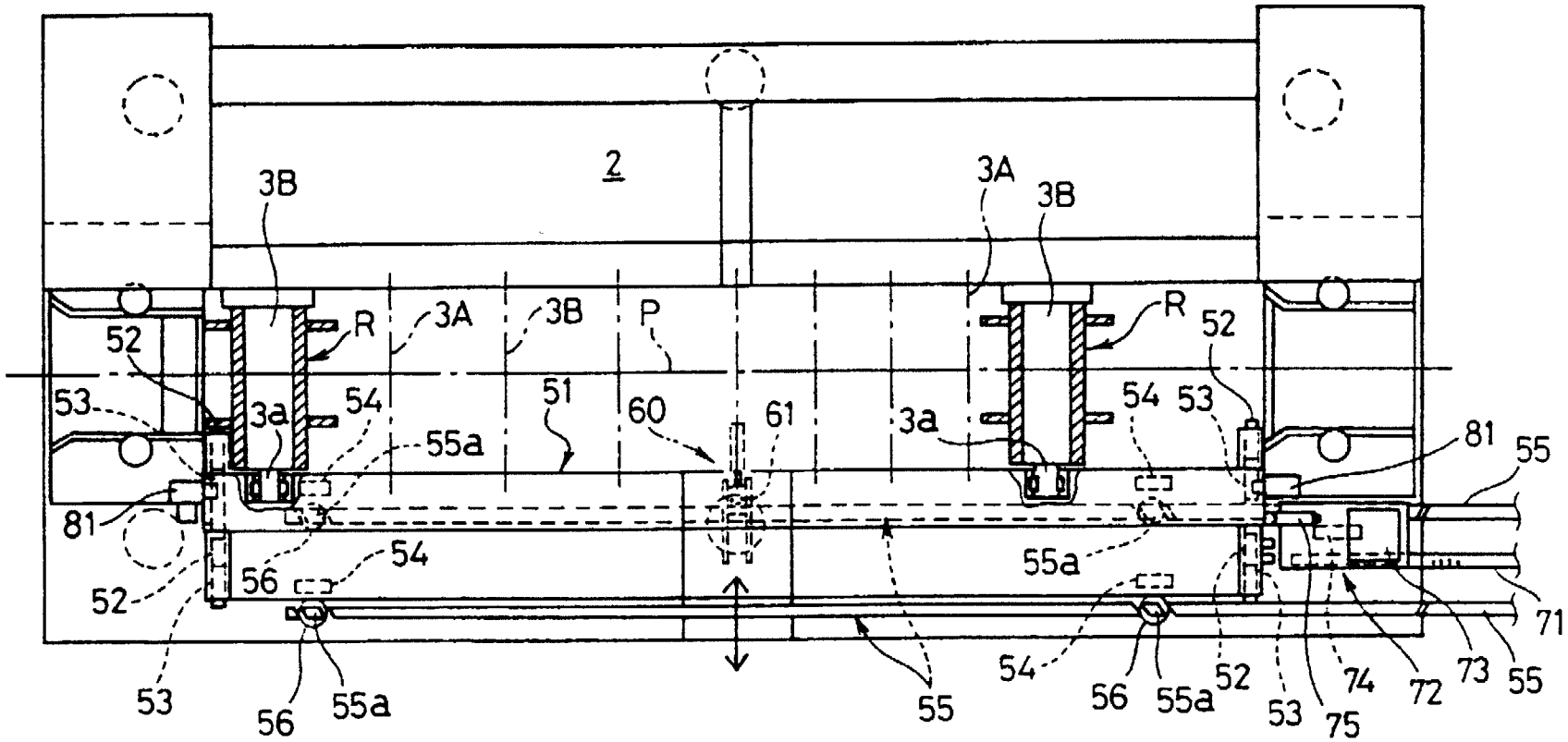
FIG. 7 is a complete plan view showing the roll support frame and bearing mount assembly for said roller correcting facility.

This roller correcting machine, as shown in FIGS. 5 through 7, comprises a roll support frame 2 having roll shafts 3A and 3B on the left-hand side of a pass line P, and a bearing mount assembly 51 having upper and lower bearings 4A and 4B supporting said upper and lower roll shafts 3A and 3B disposed on the right-hand side of the pass line P.

This bearing mount assembly 51 is moved away from the roll support frame 2 to release the upper and lower bearings 4A and 4B from the roll shafts 3A and 3B. And the bearing mount assembly 51 is moved from its retracted position to the downstream side in parallel with the pass line P, thereby providing an open space on the side associated with the front ends of the roll shafts 3A and 3B, so as to define a roll exchange operation space 30. And the roll exchange carriage 40 is moved into this roll exchange operation space 30 to exchange straightening rolls R.

The arrangement is described below in more detail.

Figure 8:
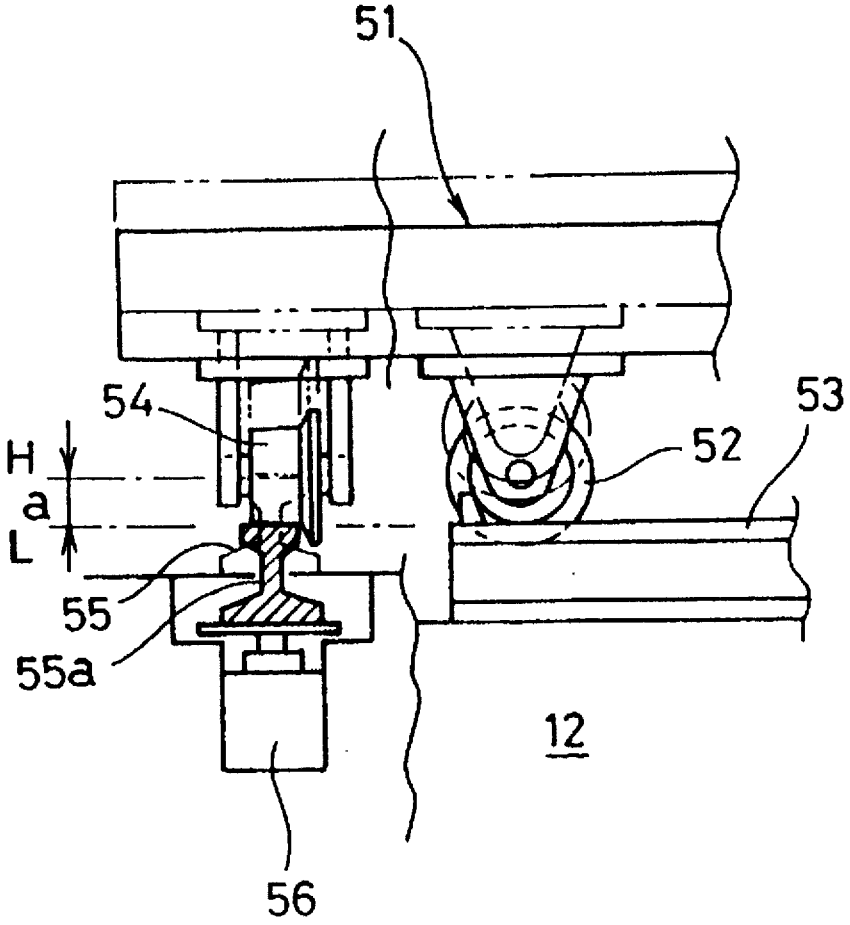
FIG. 8 is a front view, in section, showing a lifting rail for said roller correcting facility.

Disposed cross-wise on the support table 12 are a pair of transversely spaced removal rails 53 laid in the direction crossing the pass line P at right angles, and a pair of longitudinally spaced shunt rails 55 extending in parallel with the pass line P continuously to the working floor located forward. Said removal rails 53 are used to guide removal wheels 52 disposed on the front and rear portions of the bearing mount assembly 51. Further, the shunt rails 55 are used to guide shunt wheels 54 disposed on the front and rear portions of the bearing mount assembly 51. Further, as shown in FIG. 8, the support level L of the removal rails 53 for the bearing mount assembly 51 is lower by an amount a than the support level H of the shunt rails 55.

Further, at four places on the shunt rails 55, there are lifting rails **55*a* separated from the shunt rails 55, said lifting rails 55*a* corresponding to the shunt wheels 54 in the retracted position of the bearing mount assembly 51. The lifting rails 55*a* are liftably supported by rail lifting cylinder devices 56, by which the lifting rails 55*a* are vertically moved between the support level H of the shunt rails 55 and a position lower than the support level L of the removal rails 53. Thereby, the removal wheels 52 moved from the shunt rails 55 onto the lifting rails 55*a* are lowered from the support level H to L by the rail lifting cylinder devices 56, whereby the shunt wheels 54 are placed on the shunt rails 55; thus, the bearing mount assembly 51 is transferred from the removal rails 53 to the shunt rails 55**.

Figure 9:
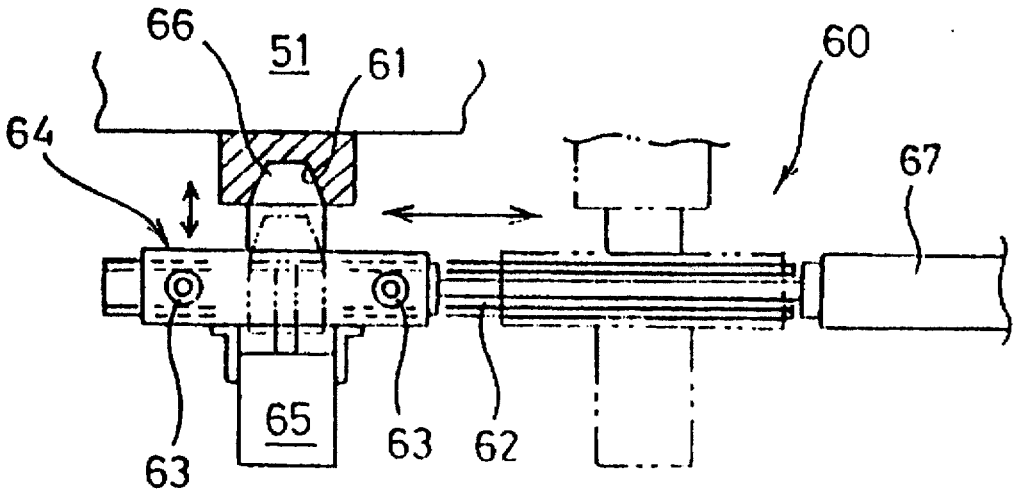
FIG. 9(*a*) and 9(*b*) show a mount drive section for said roller correcting facility, (a) being a front view in section, (b) being a side view in section.
Figure 9:
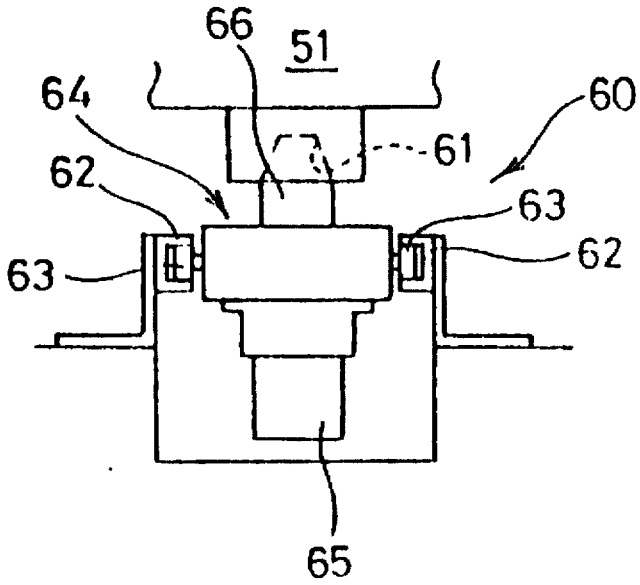

As shown in FIG. 9, the middle bottom portion of the bearing mount assembly 51 is formed with a pin hole 61 which receives removal drive power. The support table 12 is formed with a removal driving device 60 associated with said pin hole 61. The removal driving device 60 comprises a pair of removal guide rails 62 extending in the direction crossing the pass line P at right angles, and a removal carriage 64 movable with wheels 63 guided by the removal guide rails 62. The removal carriage 64 comprises a advancing and retracting cylinder device 65, and an engaging pin 66 adapted to be driven by said advancing and retracting cylinder device 65 to be inserted into and removed from the pin hole 61. A removal cylinder device 67 attached to the support table 12 has a piston rod connected to said removal carriage 64.

Figure 10:
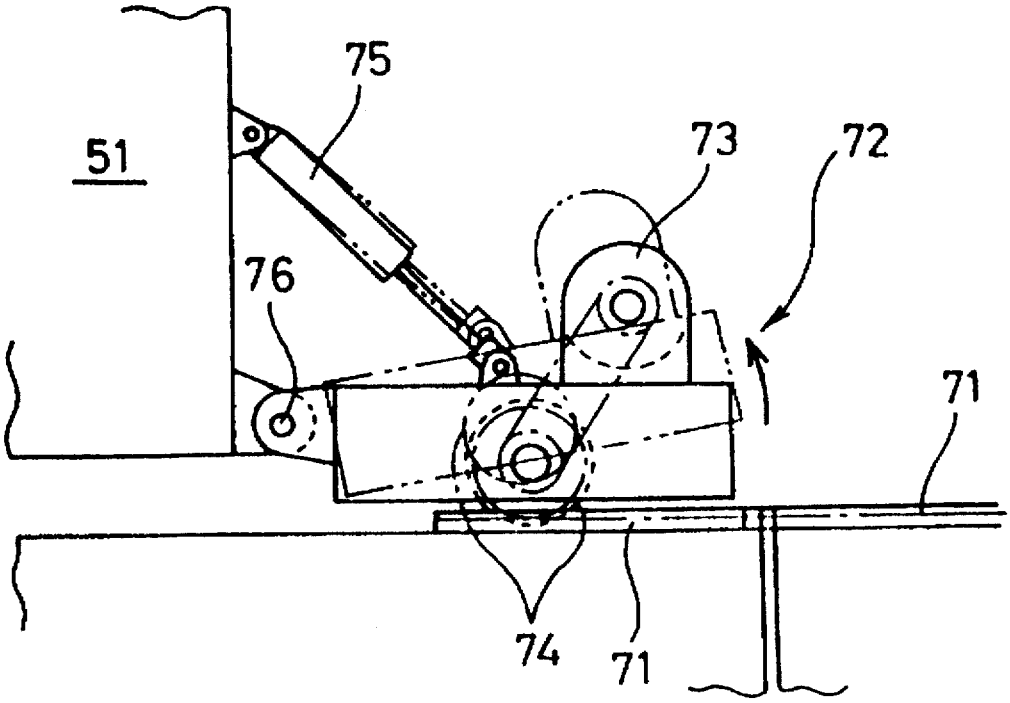
FIG. 10 is a side view showing a shunt drive carriage for said roller correcting facility.

A shunt rack 71 continuous with the working floor located forward is laid on the front region of the space between the shunt rails 55 for the support table 12. As shown in FIG. 10, a shunt drive carriage 72 is disposed forwardly of the bearing mount assembly 51 and is connected the bracket of the bearing mount assembly 51 for vertical swing around the axis of a horizontal pin 76. The shunt drive carriage 72 is provided with a shunt drive pinion 74 which is driven by a shunt drive motor 73 through a speed reducing mechanism, said pinion meshing with the shunt rack 71.

Therefore, the shunt drive pinion 74 is driven for rotation by the shunt drive motor 73 and its reaction is supported by the shunt rack 71, whereby the shunt drive carriage 72 is moved to move the bearing mount assembly 51 for shunting. Further, a carriage raising cylinder device 75 is pin-connected between the bearing mount assembly 51 and the shunt drive carriage 72. Therefore, the carriage lifting cylinder device 75 is contracted to turn the shunt drive carriage 72 upwardly around the axis of a horizontal pin 76, thereby removing the shunt pinion 74 from the shunt rack 71.

In FIG. 7, the numeral 81 denotes locking devices for fixing the bearing mount assembly 51 by lock pins inserted into pin holes by locking cylinders at the position of use where the roll shafts 8A and 3B are supported by the bearings 4A and 4B and at front and rear positions.

The roll exchange operation in the correction roll facility arranged in the manner described above will now be described.

(1) After the drive motors 14A and 14B have been stopped, the pitch adjusting devices 13 and the pitch adjusting motors 33 and upper and lower position adjusting motors 38 are driven to slide roll shafts 3A and 3B and bearing boxes 31A and 31B, with the roll shafts 3A and 3B returned to the exchange preparation position.

(2) The shunt cylinder device 65 projects the engaging pin 66 into the pin hole 61. And after the locking devices 81 have been released, the removal cylinder device 67 is extended to retract the bearing mount assembly 51 with the removal wheels 52 guided by the removal rails 53. Further, the bearings 4A and 4B of the bearing mount assembly 51 are extracted from the support portions 3*a* of the roll shafts 3A and 3B, whereupon the bearing mount assembly 51 is stopped.

(3) The advancing and retracting cylinder 65 is contracted to remove the engaging pin 66 from the pin hole 61. Thereafter, the rail lifting cylinder devices 58 are extended to lift the lifting rails 55*a*, whereby the bearing mount assembly 51 is lifted with the shunt wheels 54 placed on the lifting rails 55*a* and is stopped at the upper limit where the shunt wheels 54 are at the same support level H as that of the shunt rails 55.

(4) The carriage lifting cylinder device 75 is extended to turn the shunt drive carriage 72 downward until the shunt drive pinion 74 meshes with the shunt rack 71. And the shunt drive motor 73 is driven to move the bearing mount assembly 51 for shunting along the shunt rails 55 to the working floor located forward in the direction of the pass line P.

(5) The roll exchange carriage 40 standing by on the working floor 42 is moved by the traveling cylinder devices 49 along the exchange transverse traveling rails 43A into the roll exchange operation space 30, where it is stopped. And the roll receiving shafts 3A and 3B are connected respectively to the roll shafts 47A and 47B.

(6) Subsequently, after the fixing of the straightening rolls R mounted on the roll shafts 3A and 3B has been released by roll width changing devices 107 to be later described, the exchange slide devices 47*a* are driven until their locking teeth are locked by the straightening rolls R. And the roll sleeves 109 together with the straightening rolls R are slid from the roll shafts 3A and 3B toward the roll receiving shafts 47A and 47B and are removed from the roll shafts 3A and 3B.

(7) The roll exchange carriage 40 is retracted to the working floor 42 by the traveling cylinder devices 49, and the exchange shaft frame 46 is turned through 180°, whereupon the roll transfer shafts 48A and 48B with the next straightening rolls R' mounted thereon are opposed to the roll shafts 3A and 3B. And the roll exchange carriage 40 is moved by the traveling cylinder devices 49 until the roll transfer shafts 48A and 48B are connected to the roll shafts 3A and 3B, respectively.

(8) The exchange slide devices 48*a* are driven to slide the straightening rolls R' together with the roll sleeves 109 from the roll transfer shafts 48A and 48B to the roll shafts 3A and 3B and are mounted on the latter and fixed in position.

(9) And after the roll exchange carriage 40 has been retracted in the direction of arrow F to the working floor 42 by the traveling cylinder devices 49, the shunt drive carriage 72 is driven to move the bearing mount assembly 51 onto the support frame 12, whereupon it is stopped with the shunt wheels 54 placed on the lifting rails 55*a*. And the rail lifting cylinder devices 56 are contracted to lower the bearing mount assembly 51 with the removal wheels 52 placed on the removal rails 53.

(10) Then, the engaging pin 66 is projected for fitting in the pin hole 61 by the advancing and retracting cylinder device 65, whereupon the removal cylinder device 67 is contracted to retract the bearing mount assembly 51 with the removal wheels 52 guided by the removal rails 53. Further, the support portions 3*a* of the roll shafts 3A and 3B are fitted in the bearings 4A and 4B of the bearing mount assembly 51. Subsequently, the bearing mount. assembly 51 is fixed in position by the locking devices 81.

(11) Further, the roll width of the straightening rolls R' is adjusted, and the pitch adjusting devices 13 and the pitch adjusting motors 33 and upper and lower position adjusting motors 38 are driven to slide the roll shafts 3A and 3B and bearing boxes 31A and 31B, thereby adjusting the corrected position of the roll shafts 3A and 3B.

According to the above embodiment, after the bearing mount assembly 51 supporting the front ends of the roller shafts 3A and 3B through the bearings 4A and 4B has been separated by being retracted, it is moved for shunting in the direction of the pass line P; thus, the space from which the bearing mount assembly 51 has thus been shunted is used as a roll exchange operation space 30. And the roll exchange device 40 is moved to the roll exchange operation space 30; thus, the exchange operation of the straightening rolls R can be easily and quickly effected.

Since the bearing mount assembly 51 is installed on the roller correcting machine having cantilever type roll shafts, the same rigidity as that obtained by dual-support type roll shafts can be attained, thus making accurate correction possible. Further, said bearing mount assembly 51 may be added to an existing correcting machine having cantilever type roll shafts.

The roll width adjusting devices 107 installed on the roll shafts of this roller correcting machine will now be described with reference to FIGS. 11 through 13.

The press rolls R consist of upper press rolls R mounted on the upper roll shaft 3A (hereinafter referred to as the roll shaft 3A) and lower straightening rolls R mounted on the lower driven roll shaft 3B (hereinafter referred to as the roll shaft 3B). Further, the roll width adjusting devices installed on the roll shafts 3A and 3B are of the same construction; therefore, the roll width adjusting device 107 installed on the roll shaft 3A alone will be described, omitting a repetitive description of the roll width adjusting device 107 on the roll shaft 3B.

A shaft adjusting device 105 for sliding the roll shaft 3A in the direction of the axis O is installed at the base end of the roll shaft 3A supported by a main bearing 103 in a roller support frame 2. Further, said upper straightening rolls R consist of a fixed roll R1 and a movable roll R2. The fixed roll R1 consists of two single rolls spaced a predetermined distance from each other and fitted on a roll sleeve 109, on which they are fixed by a fixing ring 109*a*. Further, the movable roll R2 consists of two single rolls fitted on the roll sleeve 109 so that it can be slid in the direction of the axis O toward and away from the fixed roll R1 by the roll width adjusting device 107; thus, a workpiece 1 is corrected within a range covering a maximum spacing shown in the upper half of FIG. 11 and a minimum spacing shown in the lower half.

This roll width adjusting device 107 comprises sleeve mounting and dismounting means 111 for mounting and dismounting the fixed and movable rolls R1 and R2 together with the roll sleeve 109 on and from the roll shaft 3A, sleeve expanding and contracting means 112 for fixing or freeing the rolls R1 and R2 and roll sleeve 109 on and from the roll shaft 3A, and roll position adjusting means 113 for sliding the movable roll R2 released from its fixed state in the direction of the axis O.

More particularly, an inner taper sleeve 121 is axially slidably fitted on the roll shaft 3A, the outer peripheral surface of said inner taper sleeve 121 being formed with an outer taper surface whose diameter gradually increases toward the front end. Further, an outer taper sleeve 122 is fitted on said inner taper sleeve 121 and is fixed at its opposite ends to the roll shaft 3A. And this outer taper sleeve 122 is formed at its inner peripheral surface with an inner taper surface adapted to fit on the outer taper surface of said inner taper sleeve 121. And the roll sleeve 109 is fitted on this outer taper sleeve 122 and is fixed in position by the sleeve mounting and dismounting means 111 housed in the front end of the roll shaft 3A.

This sleeve mounting and dismounting means 111 comprises a shaft hole 123 formed in the center of the roll shaft 3A, an axially movable actuating shaft 172 engaged with the threaded portion 171 of this shaft hole 123, a taper sleeve 124 fixed to the front end of said actuating shaft 172, four radial pin holes 125 angularly spaced at intervals of 90° C. from the shaft hole 123, four cotter pins slidably inserted in said pin holes 125, and conversion members 127 interposed between the cotter pins 126 and the taper surface of the taper sleeve 124.

And solenoid clutch 173 capable of fixing and freeing the actuating shaft 172 on and from the roll frame 2 is installed in the shaft hole 123 at the base end of the roll shaft 3A. Further, the axial movement of wedge members 124 is converted into the advancing and retracting movement of the cotter pins 126 by the conversion members 127. Therefore, when the actuating shaft 172 is fixed on the roll support frame 2 by the solenoid clutch 173 and the roll shaft 3A is rotated, the actuating shaft 172 is pushed and pulled in the direction of the axis O under the action of the threaded portion 171. And the movement of the taper sleeve 124 causes the cotter pins 126 to advance and retract under the action of the conversion members 127. Therefore, with the cotter pins 126 projected, their front inclined surfaces press the front end surface of the roll sleeve 109 to fix the latter between the step portion **122*a* of the outer taper sleeve 122 and the cotter pins 126 and, reversely, the cotter pins 126 sink in the pin holes 125, thereby freeing the roll sleeve 109**.

The inner and outer peripheral surfaces of the inner taper sleeve 121 are centrally formed with oil grooves 128 for enlarging the slide clearances on the inner and outer surfaces of the inner taper sleeve 121. At the base end side of the inner taper sleeve 121, a returning oil chamber 129 is formed for driving the inner taper sleeve 121 toward the front end. Further, at the front end side of the inner taper sleeve 121, a thrusting oil chamber 130 is formed for driving the inner taper sleeve 121 toward the base end. And the hydraulic pressure fed from a hydraulic device 131 installed outside is fed to the oil groove 128 and oil chambers 129 and 130 via a coupling 133 removably installed on the front end of the roll shaft 3A and oil feed holes 134A through 134C formed in the roll shaft 3A. These inner and outer taper sleeves 121 and 122, oil groove 128, returning oil chamber 129, thrusting oil chamber 130 and their hydraulic fluid feeding mechanism constitute the sleeve expanding and contracting means 112.

In the above arrangement, feeding the hydraulic pressure to the oil grooves 128 through the oil feed hole 134A enlarges the slide clearance of the inner taper sleeve 121 to reduce the friction resistance. This ensures smooth slide of the inner taper sleeve 121 in the direction of the axis O. Further, feeding the hydraulic pressure to the returning oil chamber 129 through the oil feed hole 134B slides the inner taper sleeve 121 toward the front end side, whereby the pressure acting on the outer taper sleeve 122 in the direction to increase its diameter is eliminated, allowing the roll sleeve 109 to decrease in outer diameter, releasing the fixing of the movable roll R2 and a width change sleeve 143 to be later described. Reversely, feeding the hydraulic pressure to the thrusting oil chamber 130 through the oil feed hole 134 slides the inner taper sleeve 121 to the base end side to impose on the outer taper sleeve 122 a pressure aching in the direction to increase its diameter, whereby the outer diameter of the roll sleeve 109 is increased, fixing the movable roll R2 and width change sleeve 143 in position.

The roll position adjusting means 113 comprises an adjusting male threaded portion 141 formed on the base end side of the roll sleeve 109, and a width change sleeve 143 fitted on the roll sleeve 109 and having an adjusting female threaded portion 142 formed on the inner surface thereof with is threadedly engaged with the adjusting male threaded portion of the roll sleeve 109. Further, as shown in FIG. 13, there is a sleeve locking assembly 147 having a locking arm 144 rotatably attached to the bearing mount assembly 51, a plurality of engaging grooves 145 axially formed on the outer peripheral surface of the width change sleeve 143, and an engaging and disengaging cylinder 146 adapted to engage and disengage the locking portion **144*a* at the front end with and from said locking grooves 145 by rotating said locking arm 144. Further, this roll position adjusting means 113 is actuated by a roll shaft rotating device which rotates the roll shaft 3A by rotating driving and driven gears 148A and 148B by the roll drive motor 14A**.

In the above arrangement, the locking arm 144 of the sleeve locking assembly 147 is locked in the locking groove 145 to restrain the rotation of the width change sleeve 143, in which state the roll drive motor 14A is driven to rotate the roll shaft 3A at low speed, moving the width change sleeve 143 in the direction of the axis O under the action of the adjusting male and female threaded portions 141 and 142, sliding the movable roll R2 for positional adjustment.

Figure 12:
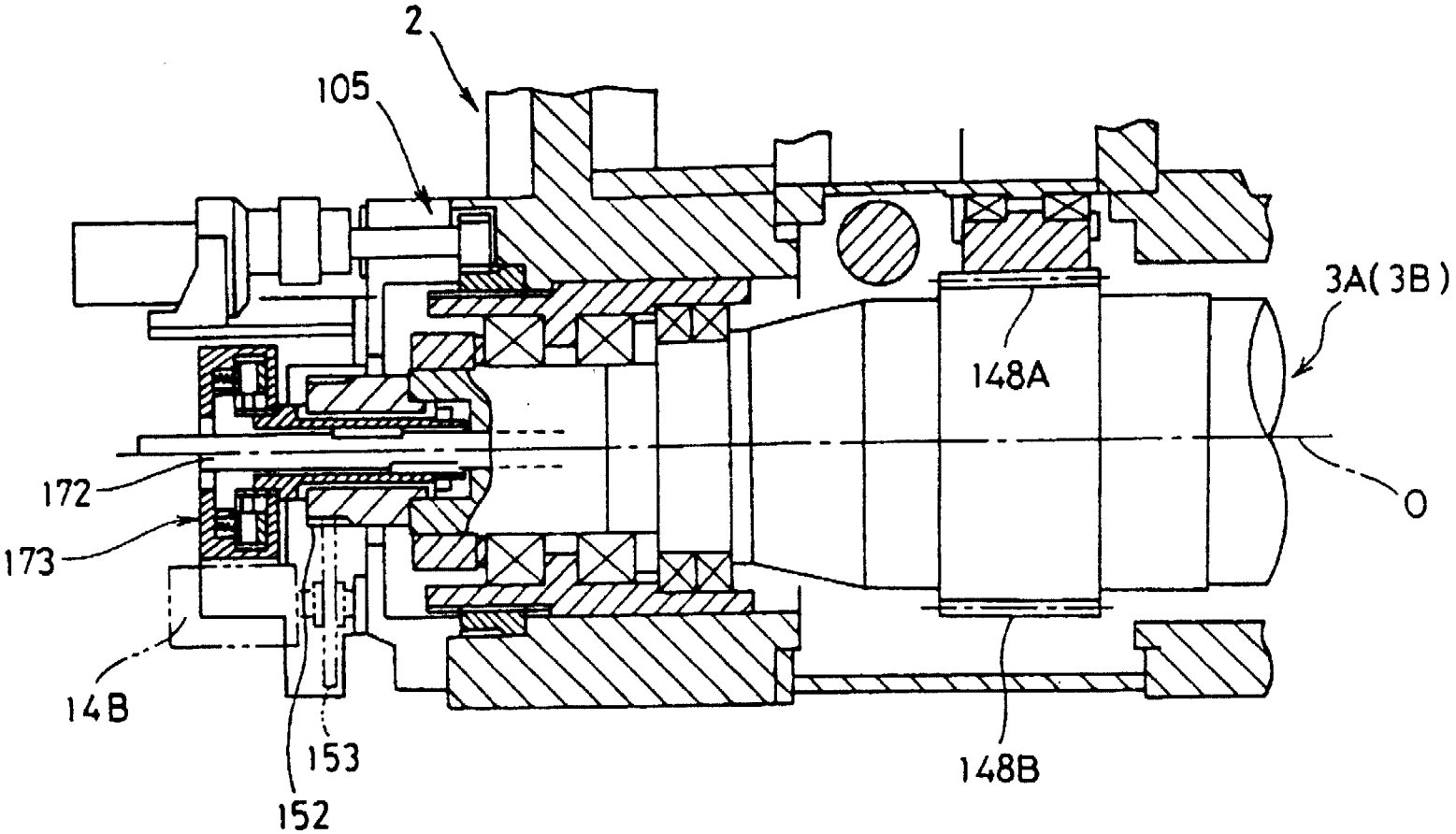
FIG. 12 is a longitudinal sectional view showing said roll width adjusting device.
Figure 13:
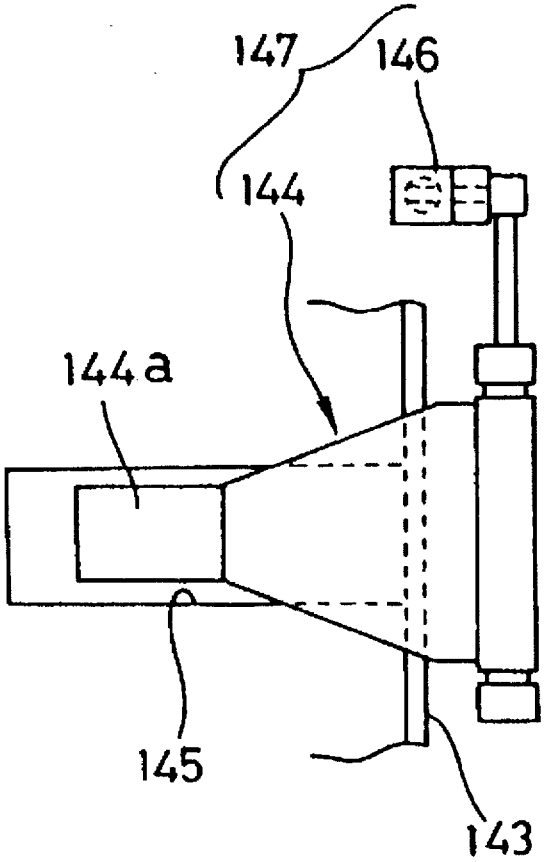
FIG. 13 is an enlarged plan view showing a sleeve locking element in said roller correcting device.

In addition, the lower driven roll shaft 3B, as shown in phantom lines in FIG. 12, is driven in that the gears 152 ad 153 are rotated by the roll drive motor 14B.

In the above arrangement, the width adjusting operation for the fixed and movable rolls R1 and R2 will now be described.

(1) The roll drive motors 14A and 14B of the roll shaft rotating device are stopped.

(2) Then, the engaging and disengaging cylinder 146 of the sleeve locking assembly 147 is driven to rotate the locking arm 144. And the locking portion **144*a* engages the locking groove 145 to restrain the rotation of the width change sleeve 143. At this time, if the locking groove 145 and the locking portion 144*a* do not coincide with each other, the roll shaft 3A is rotated at low speed by the roll drive motor 14A**.

(3) Hydraulic pressure from the hydraulic device 131 is fed first to the oil grooves 128 through the coupling 133 and oil feed hole 134A to enlarge the slide clearance of the inner taper sleeve 121 to reduce the friction resistance. Then, hydraulic pressure is fed to the returning oil chamber 129 through the oil feed hole 134B to slide the inner taper sleeve 121 toward the front end as indicated by the arrow G. As a result, the pressure applied from the outer taper sleeve 122 in the direction to increase the diameter of the roll sleeve 109 is removed to release the fixing of the movable roll R2 and width change sleeve 143.

(4) The hydraulic pressure is discharged from the oil grooves 128 to release the roll sleeve 109 from the pressure applied thereto by the outer taper sleeve 122. And the actuating shaft 172 is fixed to the roll support frame 2 by the solenoid clutch 173. Further, the roll shaft 3A is rotated at low speed by the roll drive motor 14A. Thereby, the width change sleeve 143 is slid in the direction of the axis O under the action of the adjusting threaded portions 141 and 142, moving the movable roll R2 to the intended position. Thereupon, the amount of travel of the movable roll R2 is measured in terms of rpm by a pulse oscillator built in the roll drive motor 14 A (14B) of the roll shaft rotating device.

(5) Hydraulic pressure from the hydraulic device 131 is fed again to the oil grooves 128 through the oil feed hole 134A to enlarge the slide clearance of the inner taper sleeve 121 to reduce the friction resistance.

Figure 11:
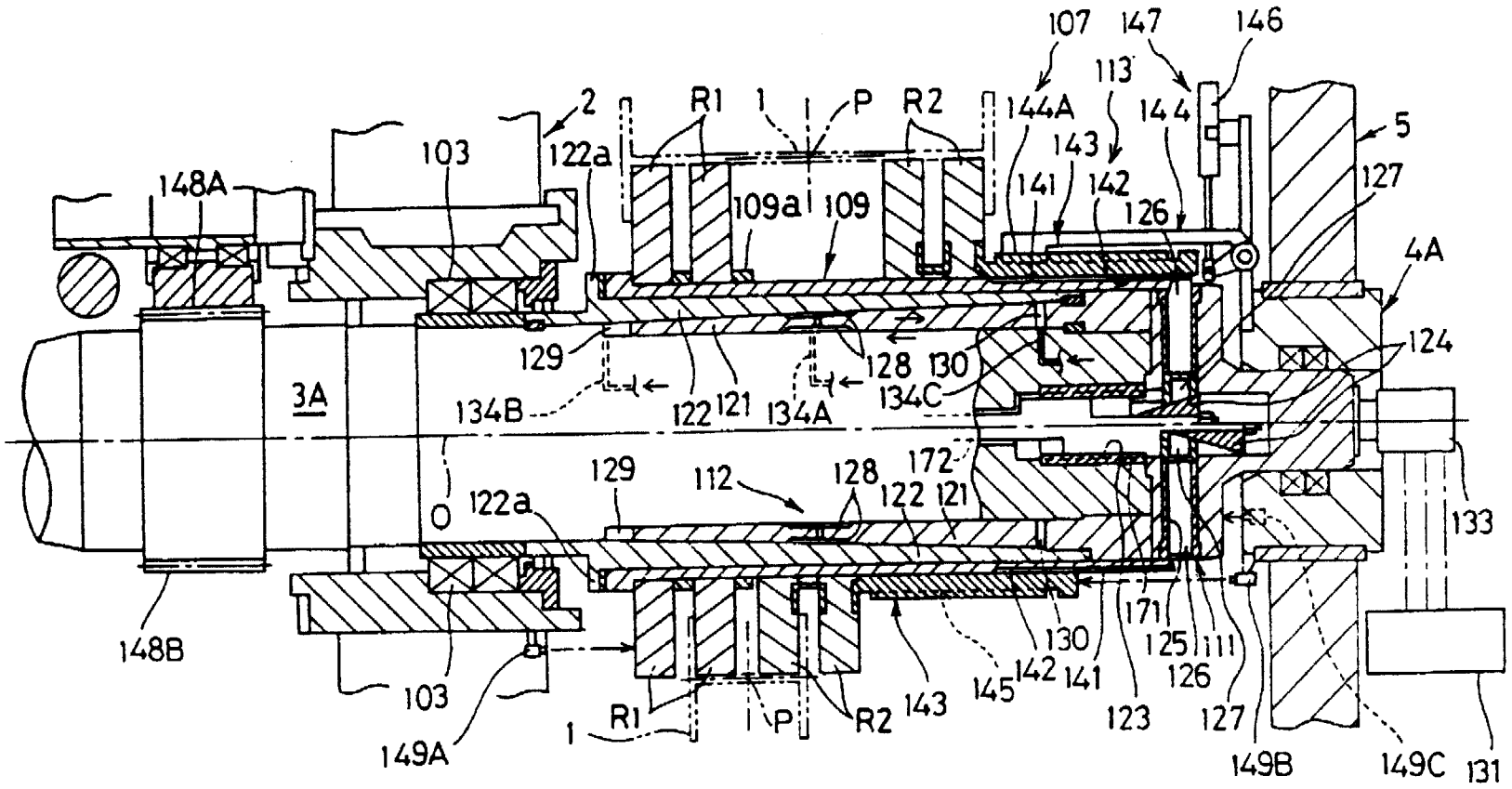
FIG. 11 is a longitudinal sectional view showing a roll width adjusting device in said roller correcting device.

(6) Further, the roll shaft 3A is axially moved by the shaft adjusting device 105, and the positions of the fixed and movable rolls R1 and R2 are detected by a plurality of ultrasonic position detectors 149A through 149C shown in FIG. 11 so as to allow the center to coincide with the pass line P.

(7) Further, in the case where the fixed and movable rolls R1 and R2 are exchanged, the roll sleeve 109 is released from fixing, thereupon the coupling 133 is removed from the roll shaft 3A. And the bearing mount assembly 5 is moved away to separate the bearing 4A from the roll shaft 3B, whereupon the fixed and movable rolls R1 and R2 together with the roll sleeve 109 are extracted from the roll shaft 3A by the roll exchange carriage 40, and new straightening rolls R1' and R2' together with a roll sleeve 109' are mounted on the roll shaft 3A. In addition, the coupling 33 is mounted and dismounted on and from the roll shaft 3A only when the fixed and movable rolls R1 and R2 are to be exchanged.

Further, in the above embodiment, ultrasonic position detectors 149A through 149C have been used for detection of the positions of the fixed and movable rolls R1 and R2; however, use may be made of non-contact type detectors, such as laser type position detectors or eddy current type position detectors, or contact type detectors wherein the piston rod is extended from a cylinder device to contact a roll and the roll position is detected from the amount of extension of the piston rod.

Figure 14:
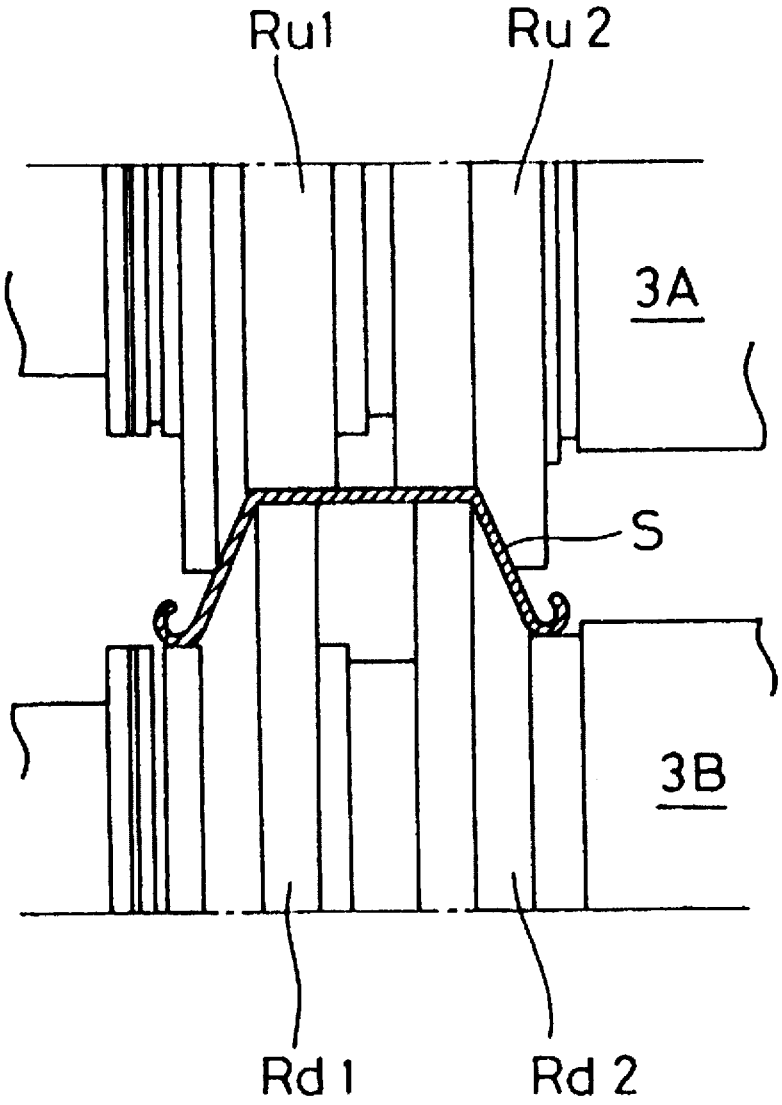
FIG. 14 is a partial front view showing the corrected state of another material to be corrected in said roller correcting facility.

Further, in the above embodiments, an H-steel shape has been illustrated as an example of a workpiece; however, as shown in FIG. 14, a workpiece, such as a sheet pile S, may be corrected or rolled by mounting a fixed rolls Ru1 ad Rd1 and movable rolls Ru2 and Rd2 of different shape on the upper and lower roll shafts 3A and 3B.

Figure 15:
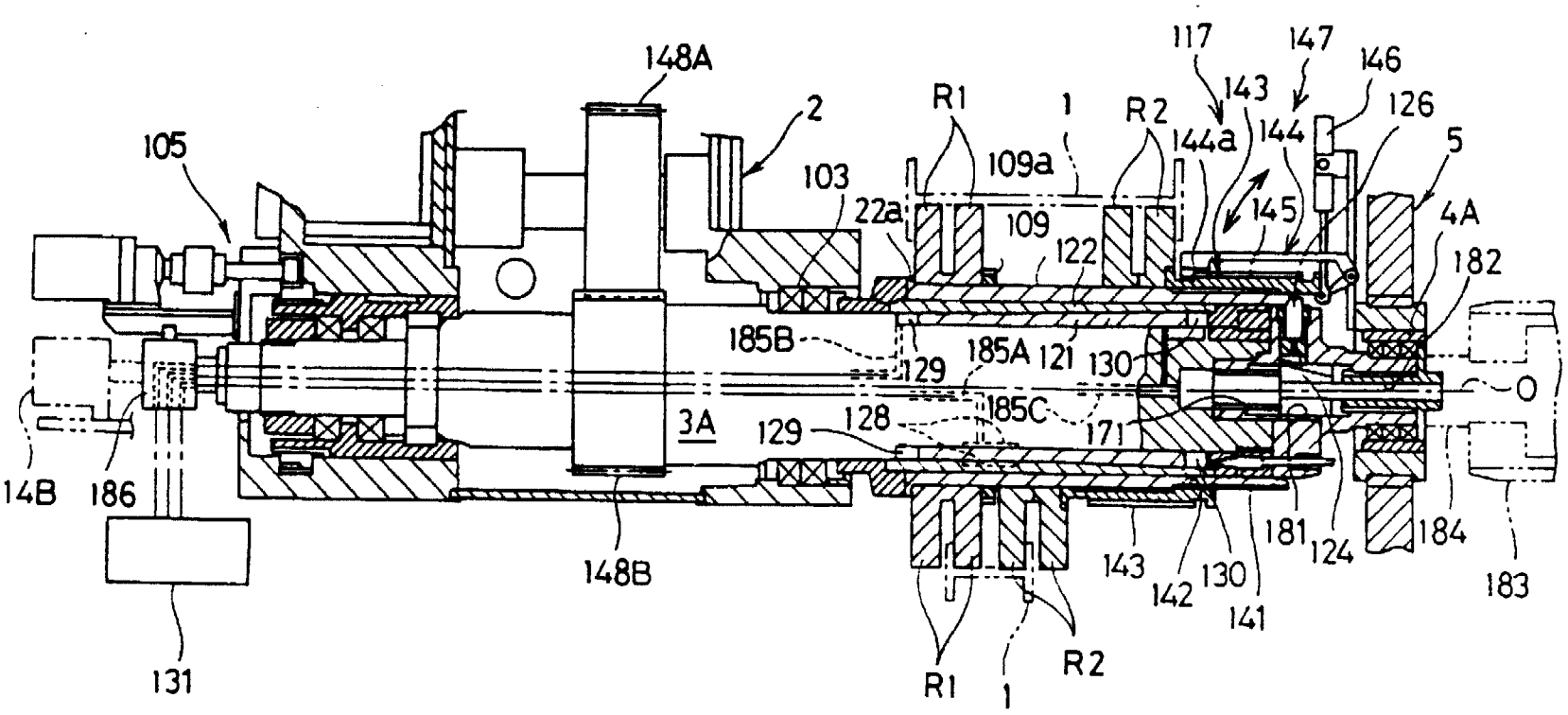
FIG. 15 is a longitudinal sectional view showing another embodiment of a roll width adjusting device in said roller correcting device.

FIG. 15 shows another embodiment of a roll width adjusting device, and the same members as those shown in the preceding embodiment are denoted by the same reference numerals to omit a repetitive description thereof.

In this embodiment, a shaft hole 181 for the sleeve mounting and dismounting means is formed in the bearing mount assembly 5, and an actuating shaft 182 installed in the shaft hole 181 is operable from the bearing mount assembly side. And after the actuating shaft 182 has been fixed on the roll exchange carriage 40 (FIG. 1) by actuating shaft fixing devices 182 installed on the roll receiving shafts 47A and 47B and roll transferring shafts 48A and 48B, the roll shaft 3A is rotated at low speed, with the result that the actuating shaft 182 is axially moved under the action of the adjusting threaded portions 141 and 142 (FIG. 15) to allow the cotter pins 26 to advance and retract so as to fix or free the roll sleeve 109.

Further, the oil feed holes 185A through 185C connected to the returning oil chamber 129, thrusting oil chamber 130 and oil grooves 128 are formed in the roll shaft 3A and located closer to the roll support frame 2 and open at the base end and are connected to the hydraulic device 131 through the coupling 186. The lower, driven roll shaft 3B is driven for rotation by the roll rotation motor 14B connected to the roll shaft 3B from outside the coupling 186.

According to the above embodiment, there is no need to remove the coupling from the roll shafts 3A and 3B for exchange of the rolls R1 and R2.

What is claimed is:

1. A roll width adjusting device in a roll processing facility having a pair of straightening rolls fitted on a roll shaft projecting from a roll support frame toward the pass line, said straightening rolls each comprising a fixed roll fixed on the roll shaft, and a movable roll movable on the roll shaft toward and away from the fixed roll, and said roll width adjusting device comprising:

an inner taper sleeve fitted for slide movement within a predetermined range on the roll shaft, an outer taper sleeve fitted on said inner taper sleeve, said outer taper sleeve having an inner peripheral taper surface contacting the outer peripheral taper surface of said inner taper sleeve, a roll sleeve fitted on said outer taper sleeve and said movable roll fitted on said roll sleeve for axial slide movement, an adjusting male threaded portion formed on the outer peripheral surface of said roll sleeve, a width change sleeve, fitted on said roll sleeve and having an adjusting female threaded portion threadedly engaged with said adjusting male threaded portion of said roll sleeve and connected to the movable sleeve, sleeve locking means for preventing rotation of said width change sleeve, sleeve expanding and contracting means for responding to the axial slide movement of the inner taper sleeve by expanding or contracting the outer diameter of the roll sleeve by its taper surface to thereby fix or release said movable roll and width change sleeve to or from the roll shaft, and roll position adjusting means responsive to the release of the movable roll and width change sleeve from the roll shaft by said sleeve expanding and contracting means and to the prevention of the rotation of the width change sleeve by the sleeve locking means, for causing the width change sleeve and movable roll to slide axially by the rotation of the roll shaft and the action of the adjusting male and female threaded portions.

2. A roll width adjusting device in a roll processing facility, the roll processing assembly including a roll support frame, a roll shaft projecting from and rotatably supported in the roll support frame, a bearing mount assembly with a bearing, the front end of the roll shaft being removably supported in the bearing on the bearing mount assembly and being movable toward and away from the roll support frame, and a pair of straightening rolls fitted on the roll shaft, each straightening roll comprising a fixed roll fixed on the roll shaft and a movable roll movable on the roll shaft toward and away from the fixed roll, said roll width adjusting device comprising:

an inner taper sleeve fitted for slide movement within a predetermined range on the roll shaft, an outer taper sleeve fitted on said inner taper sleeve, said outer taper sleeve having an inner peripheral taper surface contacting the outer peripheral taper surface of said inner taper sleeve, a roll sleeve fitted on said outer taper sleeve and said movable roll fitted on said roll sleeve for axial slide movement, an adjusting male threaded portion formed on the outer peripheral surface of said roll sleeve, a width change sleeve, fitted on said roll sleeve and having an adjusting female threaded portion threadedly engaged with said adjusting male threaded portion of said roll sleeve and connected to the movable sleeve, sleeve locking means for preventing rotation of said width change sleeve without limiting the axial movement of said width change sleeve, sleeve expanding and contracting means for responding to the axial slide movement of the inner taper sleeve by expanding or contracting the outer diameter of the roll sleeve by its taper surface to thereby fix or release said movable roll and width change sleeve to or from the roll shaft, roll position adjusting means responsive to the release of the movable roll and width change sleeve from the roll shaft by said sleeve expanding and contracting mean and to the prevention of the width change sleeve from rotating by the sleeve locking means for causing the width change sleeve and movable roll to slide axially by the rotation of the roll shaft and the action of the adjusting male and female threaded portions, a returning oil chamber and a thrusting oil chamber formed on the opposite ends of the inner taper sleeve in the sleeve expanding and contracting means for axially sliding the inner taper sleeve, an oil feed hole is formed in the roll shaft for supplying hydraulic pressure to said returning and thrusting oil chambers, and a coupling is installed on that end of the roll shaft associated with the roll support frame.

* * * * *